United States Patent [19]

Larsen et al.

[11] 4,441,869

[45] Apr. 10, 1984

[54] POWER CONVERSION MACHINE HAVING A NUTATING PISTON

[76] Inventors: Thor Larsen, Nils Langhellesvei 31, 5033, Fyllingsdalen; Terje Samdal, Smoeraaslia 24, 5050, Nesttun, both of Norway

[21] Appl. No.: 339,777

[22] Filed: Jan. 15, 1982

[30] Foreign Application Priority Data

Mar. 2, 1981 [NO] Norway ..... 810691

[51] Int. Cl.[3] ..... F01C 1/00; F01C 19/00

[52] U.S. Cl. ..... 418/51; 418/53

[58] Field of Search ..... 418/49–53, 418/68; 123/241

[56] References Cited

U.S. PATENT DOCUMENTS

| | | | |
|---|---|---|---|
| 548,584 | 10/1895 | Nash | 418/53 |
| 2,992,635 | 7/1961 | Nasvytis | 418/53 |
| 3,570,246 | 3/1971 | Briggs | 418/53 |

FOREIGN PATENT DOCUMENTS

| | | | |
|---|---|---|---|
| 251525 | 10/1912 | Fed. Rep. of Germany | 418/53 |
| 466916 | 10/1928 | Fed. Rep. of Germany | 418/53 |
| 614292 | 6/1935 | Fed. Rep. of Germany | 418/53 |
| 820596 | 8/1937 | France | 418/53 |

*Primary Examiner*—John J. Vrablik
*Attorney, Agent, or Firm*—Kenyon & Kenyon

[57] ABSTRACT

The power conversion machine has a piston which is adapted to effect a combined turning and rocking movement internally in a double-curved space. The piston is in drive connection with a rotary shaft via an eccentric disc which is obliquely disposed on the center axis of the rotary shaft. The center axis of the rotary shaft and the center axis of the eccentric disc cross each other in the center of the double-curved space. The double-curved space in defined within a ball shell and is divided into two opposing substantially ball-shaped spaces by means of a stationarily secured circular partition plate. The piston operates simultaneously in the two semi-spherical spaces, the piston passing through the partition plate via a diametrically extending slot. The piston comprises a disc-shaped main portion, and two oppositely directed roller portions which are received in respective semi-spherical spaces. The roller portions are adapted to roll against their respective side of the partition plate, which the main portion is adapted to move with a combined turning and rocking movement in the slot of the partition plate.

18 Claims, 21 Drawing Figures

POWER CONVERSION MACHINE HAVING A NUTATING PISTON

This invention relates to a power conversion machine. More particularly, this invention relates to a power conversion machine having a nutating piston.

Heretofore, various types of power conversion machines have been known which employ a nutating disc or like structure. Generally, these machines have been constructed with a piston which is adapted to effect a combined turning and rocking movement internally within a double-curved space. The piston is usually in drive connection with a rotary shaft via an eccentric disc which is obliquely disposed on the axis of the shaft such that the axis of the shaft and the axis of the eccentric disc intersect in the center of the double-curved space.

These nutating disc machines can be used in various manners. For example, U.S. Pat. No. 3,102,517 describes a nutating disc internal combustion engine. As described, an annualar piston is secured on the periphery of a ball which is moveable in an annular chamber. The annular chamber has a greater height than the piston and is defined in a ball sector belt between the internal ball and an external engine housing. Opposing ball shell portions of the ball are received in corresponding spherically concave cavities in an engine housing axially outside the ball sector belt. The annular piston is adapted to effect a combined roll and rock movement in the annular chamber in the ball sector belt. The piston (and associated internal ball) is prevented from being turned about its main axis, and the roll and rock movement is produced in the piston due to its main axis being subjected to a double conic surface movement. This double conic surface movement of the main axis of the ball and the piston is obtained due to a non-turnable shaft pin of the ball being set via a ball bearing in an eccentric disc which is rigidly connected to an associated rotary shaft. The center axis of the rotary shaft and the center axis of the piston form an acute angle with each other. The hollow space on the one side of the annular piston is employed as a combustion chamber and the opposite chamber as a compression chamber. It is expected that significant problems occur with the balancing of the eccentric mechanism, and that this imbalance is reinforced during operation by variable compression and explosion phases in the compression chamber and the combustion chamber.

U.S. Pat. No. 3,156,222 describes a power conversion machine where a piston is set into a combined turning and rocking movement in a not completely spherical hollow space. This hollow space has a spherical main surface and an opposing level surface or a somewhat undulating surface. In a first embodiment, which shows a combustion engine with internal combustion, a separate rotor member rotates along the level surface of the hollow space in slide contact with the latter, while the piston per se is set in rotation together with the rotor member and an eccentric disc which is connected to the piston and associated rotary shaft. In a second embodiment, which is used as a hydraulic motor or pump, the separate rotor member has been left out and the piston has instead been allowed to assume an undulating movement along a correspondingly undulating surface in the not completely spherical hollow space. In both instances, there is a significant dead space in the two part hollow space which is defined by the piston in the inner hollow space which is defined by the piston in the inner hollow space of the machine.

German Pat. No. 466,916 of Oct. 15, 1928 describes a pump with a piston composed of a pair of conically-shaped pistons which are adpated to move within respective hemi-spherical chambers. In addition, the piston includes an abutment for dividing the working spaces of the pump into suction and pressure spaces. However, this pump requires a working cycle of 720°, i.e., a 360° volume expansion followed by a 360° volume compression, for each of the two working chambers.

Accordingly, it is an object of the invention to utilize the combined rotary and swing movement of a nutating piston by allowing the piston to be driven via an eccentric disc or by allowing the piston to drive an eccentric disc, so that a larger effect of the work of the piston can be achieved.

It is another object of the invention to arrange the piston of a nutating machine in such a manner that the member surfaces of the piston and member surfaces of the working chamber respectively can be increased and reduced in area during the working cycle by a particular piston movement so as to achieve an extra volume utilization of the available volume of the working chamber.

It is another object of the invention to achieve an especially high volume capacity of a power conversion machine having a nutating piston.

Briefly, the invention provides a power conversion machine which comprises a housing having a pair of portions defining a double-curved space and a stationary partition plate secured between the housing portions to divide the space into two semi-spherical chambers. In addition, the plate has a diametrically extending slot disposed along a first axis.

The machine also has a piston formed of a disc-shaped main portion which extends through the slot in the partition plate and a pair of oppositely directed roller portions. The main portion is disposed for pivoting about the axis of the slot and for rocking about a second axis perpendicular to the axis of the slot and intersecting at a center point of the double-curved space. Each roller portion is received in a respective one of the semi-spherical chambers for rolling on a respective side of the partition plate during pivoting of the main piston portion.

Further, a rotary shaft extends into the housing on a third axis which is perpendicular to each of the first and second axes and passes through the center point of the double-curved space. Further, an eccentric disc is obliquely disposed to the shaft within one of the semi-spherical chambers and is in driving relation with the roller portion in this chamber.

According to the invention, a most major advantage is obtained due to the machine being adapted to give a particularly high volume capacity, that is the machine can give a significantly greater volume capacity than that which is possible with known constructions which is based upon giving alternate volume expansion and volume compression. Important reasons for the large volume capacity is, first, that the spherical space which is divided into the two approximately semi-spherical spaces by means of the diametrically extending partition plate can be utilized in an effective manner by opposing portions of the piston. The piston can operate simultaneously in the two semi-spherical spaces by being turned via the slot in the partition plage. By means of a special molding on the piston, which can be moved in the slot in the partition plate, the compression effect and the expansion effect can be utilized in an especially favorable manner in the available chamber portions, which can all be utilized as work chambers in an effective manner.

A completely special effect is achieved by means of the special roller portion of the piston, since the piston can effect a rolling off movement towards the partition plate. In this way, the piston can divide up the chamber on one side of the piston into two chamber portions, that is a part chamber with compression volume and a subsequent part chamber with expanding volume.

By dividing up the chamber on one side of the piston into two part chambers by means of the roller portion of the piston, the operating cycle of the piston can be extended (including an expansion phase and a subsequent compression phase) from a convention cycle of 360° to a cycle of 540°. The volume formation is based on the chamber volume being evolved from zero size to maximum size and back to zero size in 1.5 turns of the rotation shaft, that is a 540° cycle. With the exception of certain particular positions (that is two opposing movement positions of the pistons where there is obtained the zero size in one chamber volume in each semi-spherical space) the piston operates the whole time against three different chamber volumes in each semi-spherical chamber. That is, the piston acts simultaneously against all six different chamber volumes, with pairs of corresponding chamber volumes in the two semi-spherical spaces. By one turn of the rotation shaft a turning angle of 360° will in this way empty from each semi-spherical chamber, two optimum volumes per rotation.

The power conversion machine according to the invention can find application in various areas. For example, the machine can be used as a passive power conversion machine with an external rotation shaft coupling on the rotation shaft of the machine, e.g., a compressor or pump (hydraulic, pneumatic). The machine can also be used as an active conversion machine, for example as hydraulic or pneumatic motor or another piston power machine for converting static pressure in steam, gases, and/or fluid to mechanical work (rotation). The machine can also be employed as a compound machine by being used as a combination of active and passive operation.

In the embodiment which is to be described in the following description, the machine in a simple design is intended to be used as an air compressor. With certain modifications, the machine can, however, be adapted for another application, as a passive power conversion machine as well as an active power conversion machine.

These and other objects and advantages of the invention will become more apparent from the following detailed description taken in conjunction with the accompanying drawings in which.

Figure 9A:
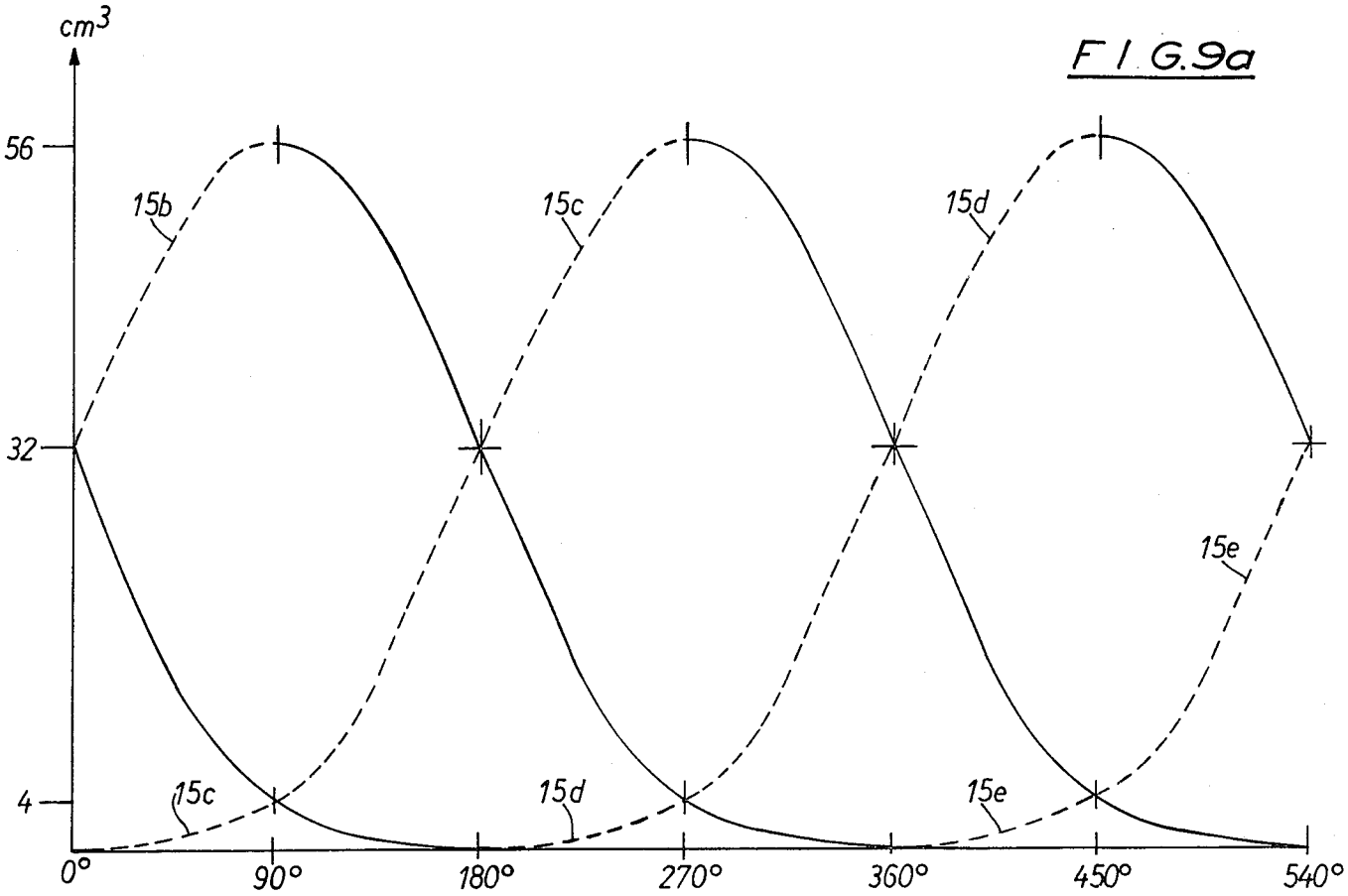
Figure 9B:
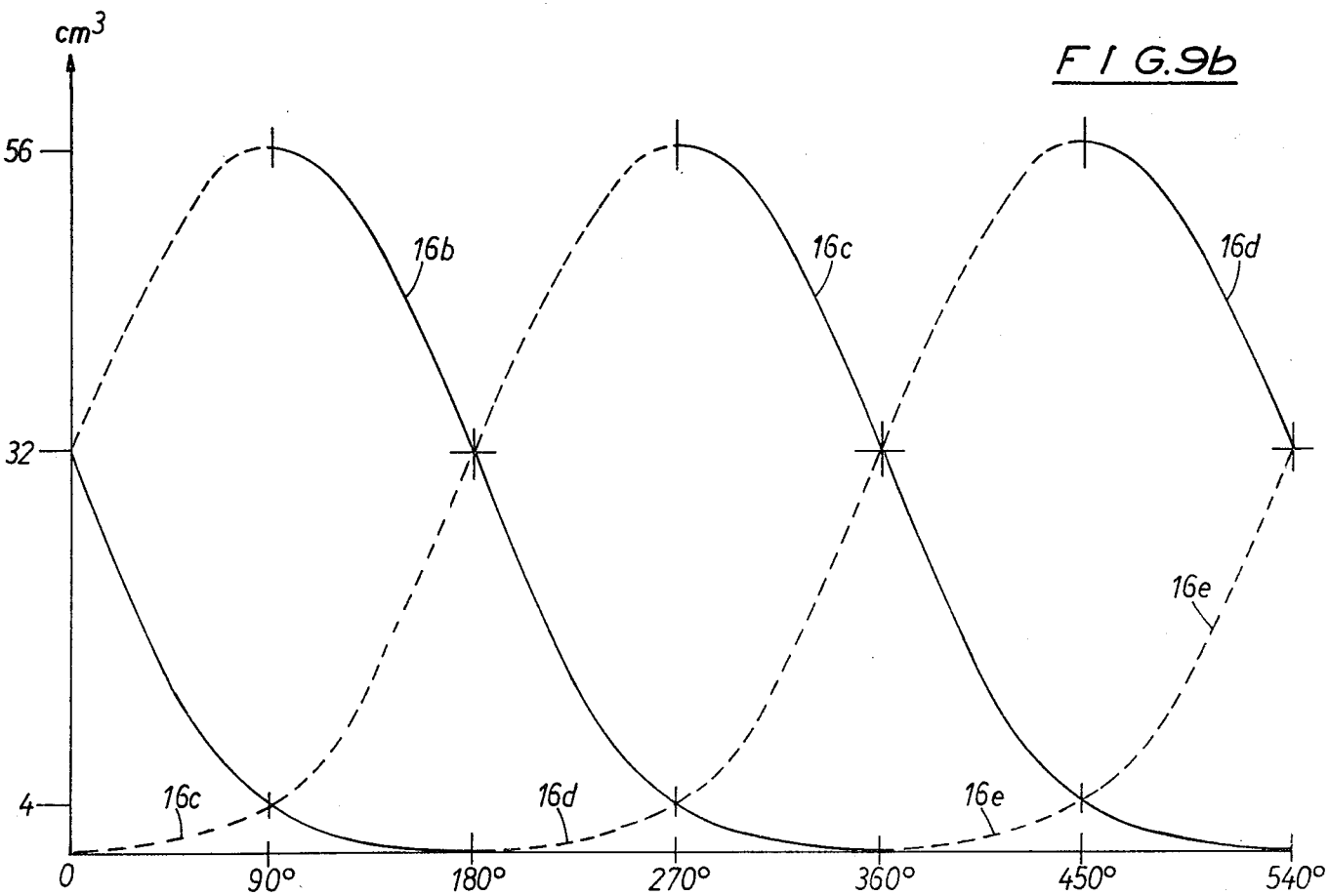
Figure 11:
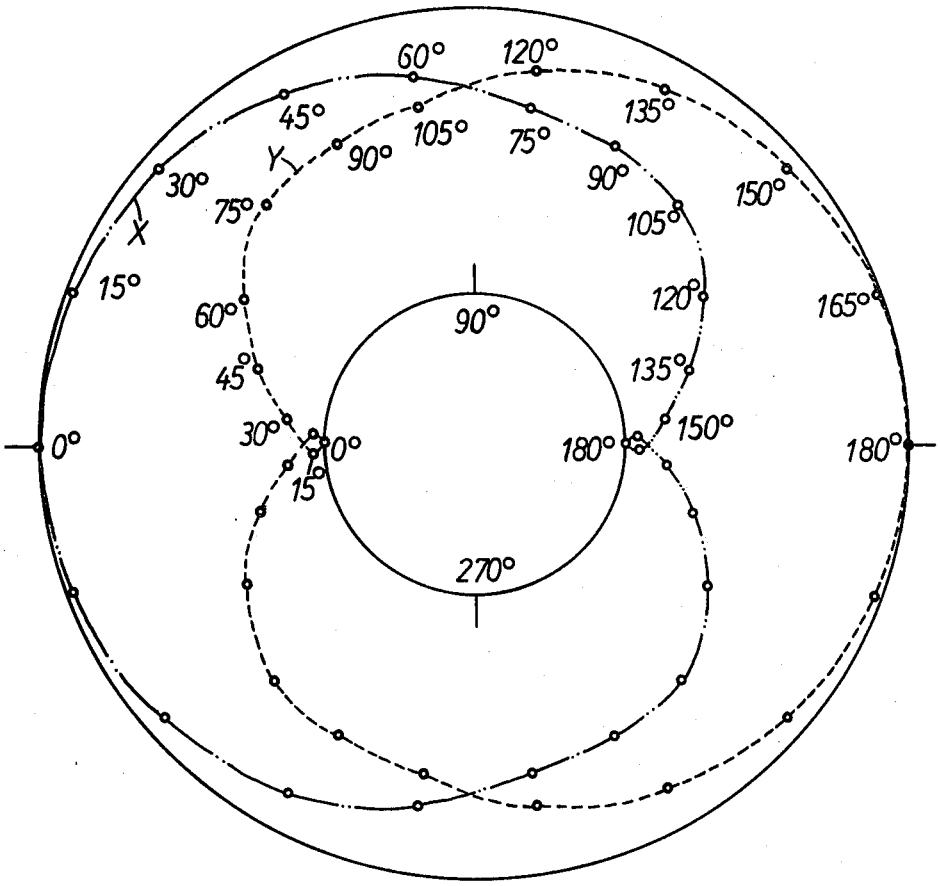
Figure 12:
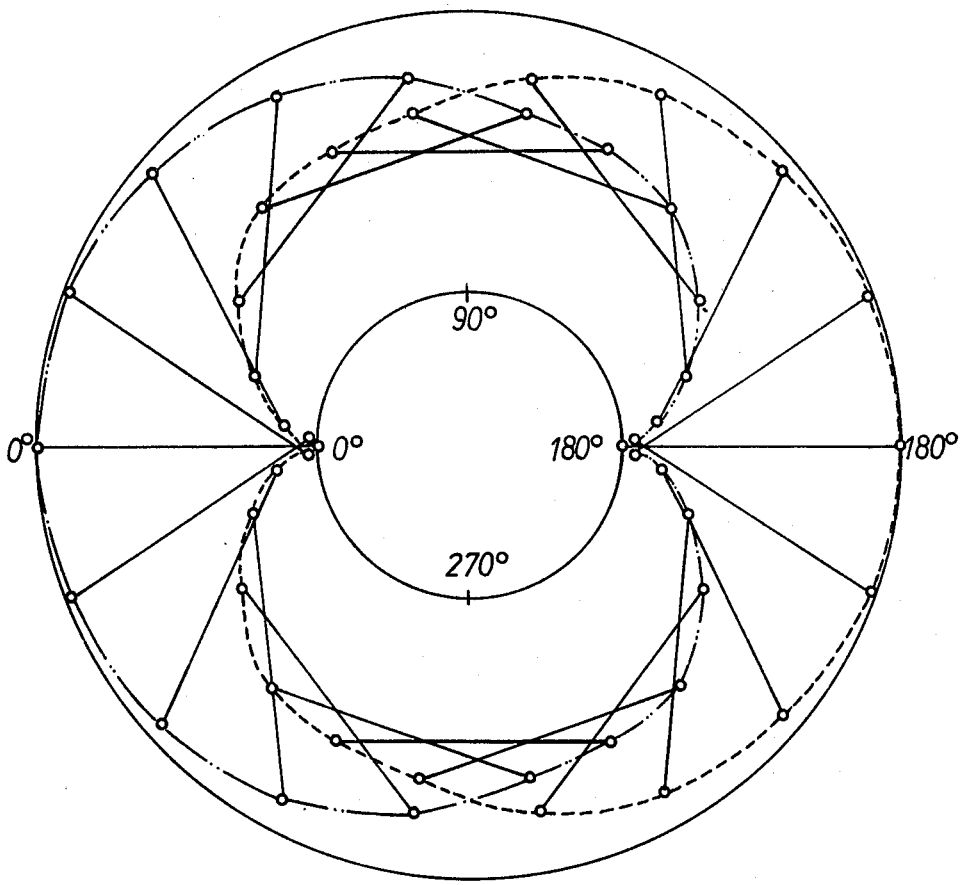

FIGS. 5*a*–8*a* schematically illustrates different phases of the movement of the piston in the machine according to the invention;

FIGS. 5*b*, 6*b*, 7*b*, 8*b* schematicaly illustrate the same phases of the movement of the piston seen in the direction of the arrow 67 of FIGS. 5*a*, 6*a*, 7*a*, 8*a*;

FIGS. 9*a* and 9*b* graphically illustrate three volume curves for three different working chambers of the machine illustrated, respectively, in a first and a second semi-spherical space;

FIGS. 10*a* to 10*e* illustrate some theoretical considerations, shown in schematic views, to clarify certain part movements of the piston in the machine according to the invention;

FIG. 11 schematically illustrates the movement pattern for certain points of the piston relative to the inner wall of the one semi-spherical space;

FIG. 12 schematically illustrates the movement pattern of the roller portion of the piston relative to the inner wall of the semi-spherical space.

In the embodiment illustrated, the power conversion machine is in the form of a compressor. With certain modifications (now shown further herein), the machine can, however, also be used for example as a hydraulic pump, hydraulic motor, combustion engine with continuous combustion, and so forth.

Figure 1:
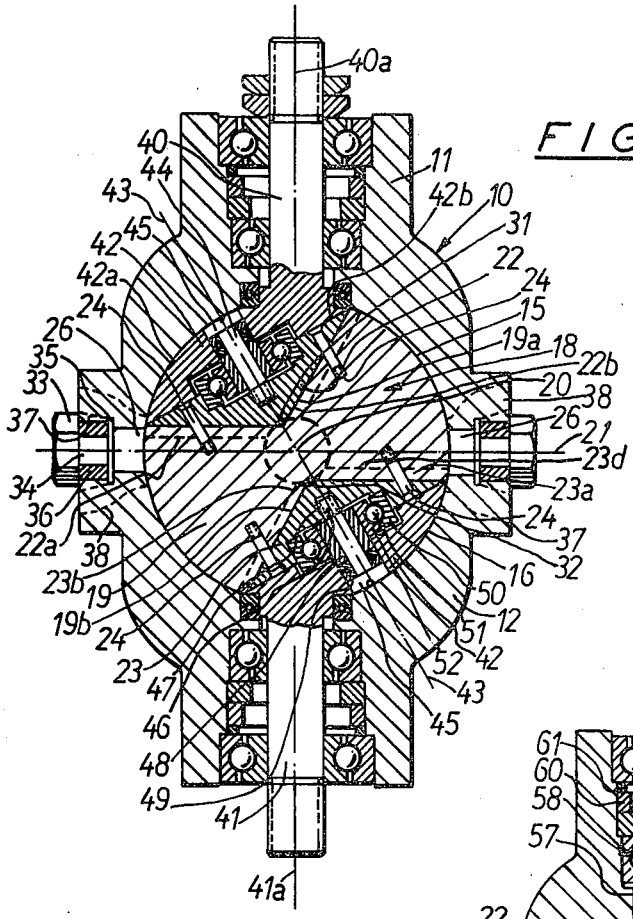
FIG. 1 illustrates a vertical section through a machine according to the invention.
Figure 2:
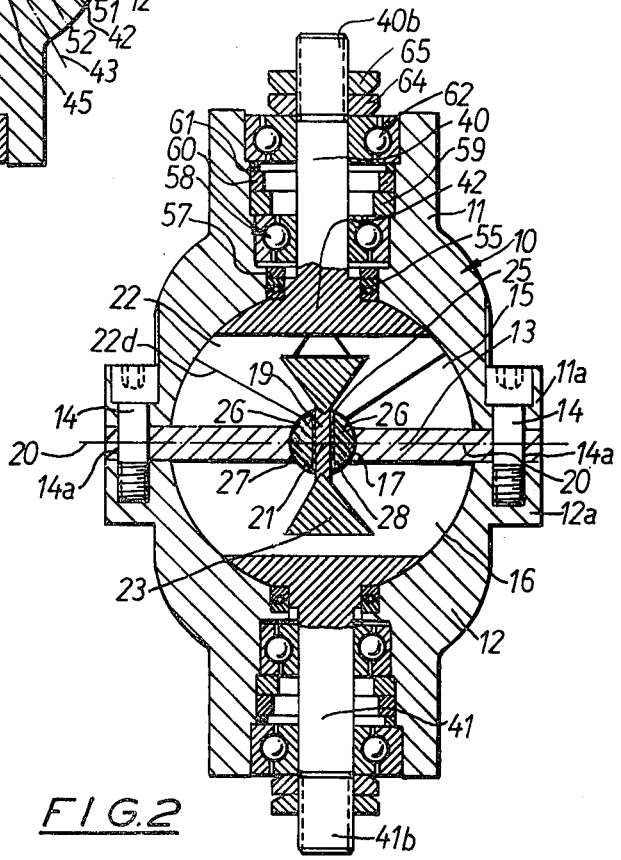
FIG. 2 illustrates a vertical section through the machine according to FIG. 1 in a plane at right angles to the section plane of FIG. 1.

Referring to FIGS. 1 and 2, the compressor has a housing 10 which is composed of two housing portions 11, 12 and an intermediate, circular partition plate 13. The partition plate 13, which physically defines the two housing portions 11 and 12 relative to each other, is rigidly connected with flange portions 11*a*, 12*a* of the two housing portions 11, 12 by means of common fastening screws 14 which pass through the partition plate 13 via fastening holes 14*a*.

The housing 10 is provided with a double-curved space, i.e., a spherical hollow space which has a center point centrally of the partition plate 13. This hollow space is divided by means of the partition plate 13 into two similar, substantially semi-spherically shaped hollow chambers 15, 16. The partition plate 13 is cut out to form a slot 17 which extends diametrically in the partition plate 13 and which forms a through passage between the hollow chambers 15, 16.

The compressor is provided with a piston 18 which is adapted to work simultaneously in the two semi-spherically shaped hollow chambers 15, 16. In this connection, the piston 18 is provided with a disc-shaped main portion 19 which is adapted to move backwards and forwards and at the same time inwards and outwards in the two hollow chambers 15, 16 with a movement about two axes 20, 21 which intersect mutually at right angles at the center point of the spherical space. One axis 20 extends at right angles to the main portion 19 through the center point of the piston 18, while the other axis 21 extends coaxially with the longitudinal center axis of the slot 17 in the partition plate 13 and thereby also through the mid-point of the piston 18. The piston 18 is adapted to be subjected to a combined turning and rocking movement about the two axes 20, 21.

The piston 18 also has a pair of roller portions in the form of conic stump-shaped portions 22, 23 which are fastened to the disc-shaped portion 19 by means of fastening screws 24. The main portion 19 is a circular disc having two oppositely disposed sector-shaped cavities 19*a*, 19*b* for the reception of the conic stump-shaped portions 22, 23. In addition, there are cut out rolling off grooves 22*a*, 22*b* and 23*a*, 23*b* in the portions 22, 23 for rolling against a crosshead pin 26. The conical angle is shown with a size of 120°, but this angle can alternatively be somewhat larger or somewhat smaller.

In the illustrated embodiment, the piston 18 consists of a coherently rigid construction of the main portion 19 and the conic stump-shaped portions 22, 23 which form roller portions in the piston. Each roller portion 22, 23 is adapted to effect, with the respective conic stump surface 22*d*, 23*d*, a rolling movement against a respective roller plane-forming side of the partition plate 13, that is, with a roller portion 22, 23 respectively received in a respective hollow chamber 16. The conic stump surfaces of the roller portions 22, 23 thus effect an equivalent rolling movement in their respective hollow chambers 15, 16 with completely balanced, synchronized movement of the two roller portions 22, 23 in the compressor housing. Simultaneously with the conic stump surfaces 22*d*, 23*d* of the roller portions 22, 23 effective a rolling off against the partition plate 13, the disc-shaped main portion 19 makes a turning movement backwards and forwards about the axis 20 over an angle of 120° (corresponding to the conic angle of the conic stump-shaped roller portions 22, 23) on movement through the slot 17 of the partition plate 13. At the same time, the main portion 19 of the piston is subject to a rocking movement of 120° about the other axis 21 in the slot 17 in the partition plate 13.

Figure 3:
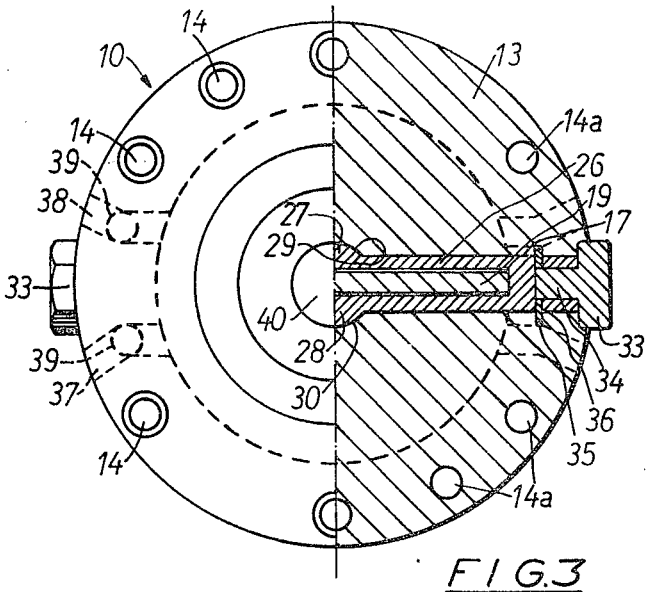
FIG. 3 illustrates an end view of the machine with certain parts broker away for the sake of simplicity.

In the illustrated embodiment, the main portion 19 of the piston 18 is led through the slot 17 in the partition plate 13 (see FIGS. 3 and 4) via a control-forming through aperture 25 in a mainly cylindrical crosshead pin 26. The aperture 25 is designed with a slide fit for the main portion 19 of the piston 18. The crosshead pin 26 is rotatable about its main axis (the axis 21) and is received with a slide fit in bearing-forming, part-cylindrical surfaces in the slot 17 in the partition plate 13. By means of the slide fits between the aperture 25 of the crosshead pin 26 and the main portion 19 of the piston 18 and the slide fit between the slot 17 of the partition plate 13 and the cylindrical outer surface of the crosshead pin 26, a simple and advantageous sealing is obtained between the parts. In the central region, the crosshead pin 26 (see FIG. 3) is formed on the opposing outer sides with semi-spherical projections 27, 28 which are received in corresponding cavities 29, 30 in the central region of the slot 17, provision being made for equivalent slide fits and thereby sealing between projections 27, 28 and the cavities 29, 30 in the partition plate 13.

Figure 4:
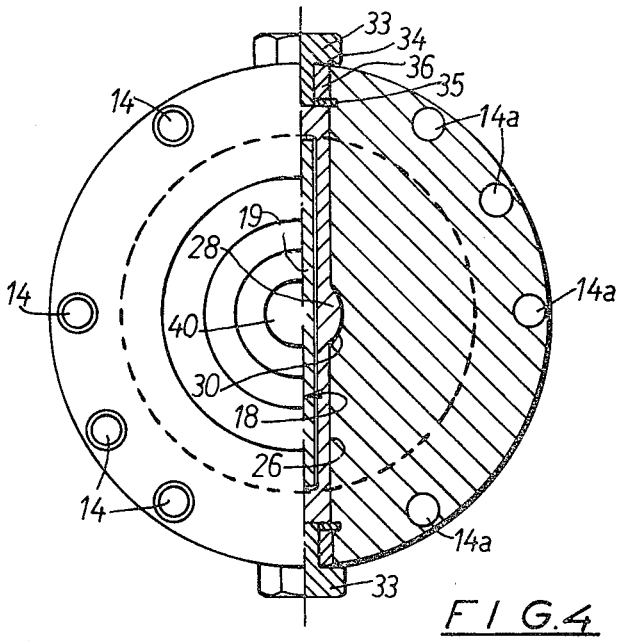
FIG. 4 illustrates a corresponding end view to FIG. 3 with certain other parts broken for the sake of simplicity.

Referring to FIGS. 2 and 4, the cylindrical crosshead pin 26 has a greater thickness (diameter) than the thickness of the partition plate 13 to project a distance outwards on the opposite sides of the partition plate 13 in the slot 17. The conic surface of the roller portion 22 (23) is adapted to effect a rolling off movement along the respective roller surface of the partition plate 13 and, in this connection, the crosshead pin 26 constitutes an obstacle to such a rolling off movement. Therefore, provision is made for the roller portions 22, 23 of the piston 18 to effect a rolling off towards the crosshead pin 26 also. In this connection, corresponding concavely rounded off grooves 22*a*, 22*b* and 23*a*, 23*b* are formed in the roller portions 22, 23. The pointed ends of the roller portions 22, 23 are correspondingly cut off and provided with concave (half moon-shaped) cavities 31, 32 which are adapted to the hemi-spherical projections 27, 28 on the outer sides of the crosshead pin 26.

The concave cavities 29, 30 in the partition plate 13 permit turning of the projections 27, 28 of the crosshead pin 26 in the slot 17 of the partition plate 13. The projections 27, 28 form a permanent slide abutment against the cavities 29, 30 in the slot 17 of the partition plate 13, while the grooves 22*a*, 23*a* and 22*b*, 23*b* form a sliding abutment against the main part of the crosshead pin 26 only in particular, defined regions of the swing movement of the piston 18 in opposing rock positions of the piston, that is in a zero fastening point and in a 180° fastening point respectively, every time a rolling off the portion 22 (23) towards the crosshead pin 26 is effected. In these instances, one part of the roller portion at the main portion 19 of the piston is in its lowest position, while the opposite part of the roller portion at the main portion 19 of the piston is in its highest position relative to the partition plate 13.

The rolling off grooves 22*a*, 22*b* and 23*a*, 23*b* of the roller portions 22, 23 provide a corresponding slide fit between the roller portions 22, 23 and the crosshead pin 26 in the rocking region of the piston 18. Provision is also made for a slide fit with a corresponding slide seal between the peripheral surface of the main portion 19 and the inner surface of the hollow chambers 15, 16.

In the illustrated embodiment, additional sealing means have been avoided and, by means of slide fits, provision has been made for sealing between the various parts which are moveable relative to each other. In practice, rubber seals can be employed in addition if desired (but not necessarily) at the surfaces where slide fits are used. If desired, the crosshead pin 26 can also be left out and, for example, rubber seals can be used directly between the disc-shaped main portion 19 of the piston 10 and the slot 17 of the partition plate 13 by fastening the rubber seals to opposite surfaces of the slot. In the last-mentioned instance provision can be made for the rubber seal to form an abutment directly against the pointed ends of the conic stump-formed, roller portion-forming portions 22, 23.

The crosshead pin 26 is pivotally mounted with a slide fit in the partition plate 13 and in the housing portion at firmly clamped side portions of the partition plate 13, radially just outside the hollow chambers 15, 16, that is at the inner portion of the wall portion of the housing portion. A sealing plug is also fastened in the outer portion of the wall portion of the housing portion on each side. As shown, each sealing plug comprises a nut 33 which is fastened to an externally threaded pin 34 which is supported on a stop disc 35 and a rubber sealing ring 36 between the stop disc 35 and the nut 33. The rubber sealing ring 36 is pressed against the inner wall in a corresponding cavity in the housing portions 11, 12. In addition, the sealing plug can serve as a grease cup for lubricating bearings of the crosshead pin 26.

By broken lines 37 and 38 (especially in FIGS. 1 and 3) there are indicated four pairs of valve ports which extend through walls of the housing portions 11, 12 to the hollow chambers 15, 16 at a certain distance from the respective sealing plugs. A ball valve 39 is also located in each valve port. The pairs of valve ports 37, 38 are disposed relatively close to the crosshead pin 26 and their respective sealing plug, that is with two pairs of valve ports opening out into each hollow chamber 15, 16 and with a valve port on each side of the respective sealing plug. The significance of this positioning will be explained below.

A means is also provided for rolling each roller portion 22, 23 on the partition plate 13 about an axis perpendicular to the plate 13. As shown in FIGS. 1 and 2, this means includes a rotary shaft 40, 41 at each end of the housing 10 which is rotatable about an axis 43 passing through the center of the housing chambers 15, 16. Each shaft 40, 41 is drivably connected to the piston 18 via the respective conic stump-shaped roller portions 22, 23. The drive connection between the roller portion 22 and 23 and the associated rotation shaft 40 and 41 is identical at opposite ends of the compressor. The operation occurs via an eccentric disc 42, the main plane of which extends obliquely to the axis 40*a*, 41*a* of the rotation shaft 40, 41. The center axis of the eccentric disc 42 is shown by chain line 43.

Each eccentric disc 42 is provided with a ball shell-shaped, outwardly directed surface 42*a* and a level, inwardly directed surface 42*b*. Each eccentric disc 42 is connected to the associated piston-roller portion 22 (23) via a thrust bearing 44*a* which is screwed fast to the eccentric disc 41 via a head portion 45 of a screw 44 and projects with the outer end of a stem portion 46 inwardly into a corresponding cavity 47 in the piston-roller portion 22 (23). The roller portion 22 (23) is adapted to be moved freely about its center axis in the eccentric disc 42, that is about the center axis 43 of the eccentric disc 42. Between the head 45 of the screw 44 and a shoulder portion 48 internally in the eccentric disc 42 there is inserted a slide seal 49. Ball bearings having inner and outer rings 50, 52 and balls 51 are arranged in oppositely facing cavities between the eccentric disc 42 and the associated piston-roller portion, the central portion of the eccentric disc 42 projecting endwise inwards into the cavity in the piston-roller portion by means of a sleeve-shaped projection to support the inner ring 52 of a ball bearing.

In the transition between the rotation shaft 40 (41) and the eccentric disc 42 and between a hollow chamber 15 (16) of the housing portion 11 and the bearing-forming portion of the housing portion, there is located a slide seal 55 (FIG. 2). In addition, a spacer ring 57 and a first ball bearing 58 (inner support bearing) for the rotation shaft are located in the housing. The support bearing 58 is held firmly in place on internal screw threads in the housing portion by means of an adjustment nut 59 and a locking nut 60. A spacer ring 61 as well as a second ball bearing 62 (outer support bearing) are held firmly in position in the housing by an adjusting nut 65 and a locking nut 65 on the outer, external threaded end 40*b* (41*b*) of the rotation shaft 40 (41). The most outermost, free portion of the rotation shaft can be employed for fastening on a suitable drive means (not shown) for the rotation shaft.

In operation of the compressor, provision is made for synchronous operation of the rotation shafts 40, 41. Alternatively, the operation can occur via one rotation shaft, the other rotation shaft being in that case free-running and mainly providing for the control of the roller portion of the piston, so as to be moved synchronously with the other roller portion of the piston which is connected to the driving rotation shaft.

In FIGS. 5*a*, 5*b*, 6*a*, 6*b*, 7*a*, 7*b*, 8*a*, 8*b*, the piston 18 is shown in four consecutive phases on turning the rotation shaft 40, 41 in the direction of the arrow 66. The piston is moved stepwise 90° from the piston shown in FIGS. 5*a* and 5*b* to the positions shown in each of FIGS. 6*a* and 6*b*, FIGS. 7*a* and 7*b* and FIGS. 8*a* and 8*b*. The views as shown in FIGS. 5*a*, 6*a*, 7*a* and 8*a* are seen from the same direction, while the views as shown in FIGS. 5*b*, 6*b*, 7*b* and 8*b* are seen in the direction of the arrow 67 in FIGS. 5*a*, 6*a*, 7*a* and 8*a*.

Figure 5A:
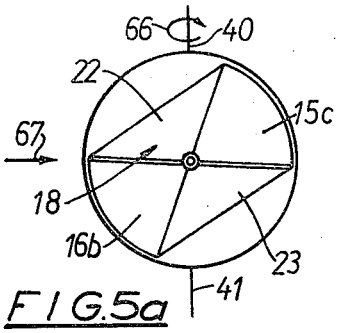
Figure 5B:
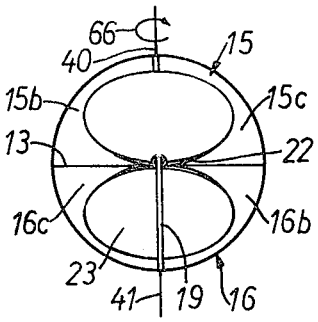

In the starting position as shown in FIGS. 5*a* and 5*b*, the piston 18 occupies a piston dividing the hollow chamber 15 into two equally large parts which are shown as part hollow chambers 15*b*, 15*c* in FIG. 5*b*.

Figure 6A:
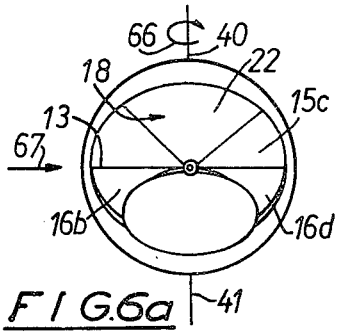
Figure 6B:
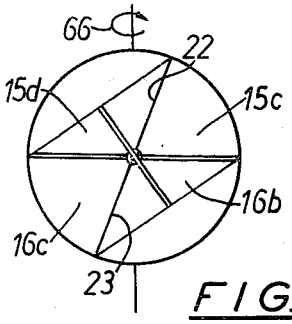

On turning of the rotation shaft 40 in the direction of the arrow 66 90° from the position shown in FIGS. 5*a* and 5*b* to the position shown in FIGS. 6*a* and 6*b*, the one part chamber 15*b* will reduce, while the other part chamber will increase. However, one must be observant here of the roller movement which is effected by the roller portion 22 of the piston 18. Gradually, as the conical surface of the roller portion 22 is rolled off against the adjacent roller track of the partition plate 13 and thereby forms a continuous sealing abutment betwen the roller portion 22 of the piston and the roller track of the partition plate 13 at an increasing distance form the main plane of the piston 18—there is obtained a further reduction of the part chamber 15*b*. At the same time, a new part chamber 15*d* forms on the same side of the main surface of the piston 18 but on the opposite side of the abutment of the roller portion 22 against the partition plate 13. In this position, the part chamber 15*c* has a maximum volume.

Figure 7A:
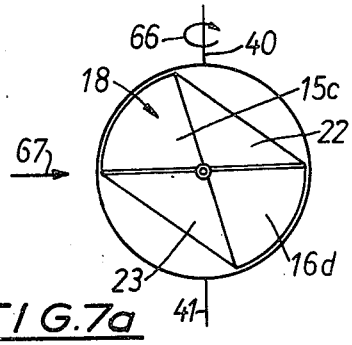
Figure 7B:
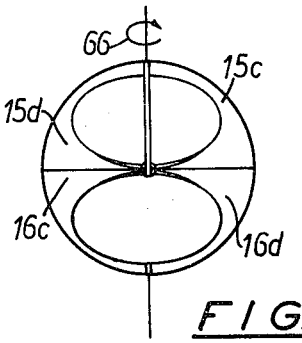

On further turning of the rotation shaft 42 in the direction of the arrow 66 90° from the position shown in FIGS. 6*a* and 6*b* to the position shown in FIGS. 7*a* and 7*b*, the part chamber 15*b* is reduced still further towards a minimum volume. At the same time, the new part chamber 15*d* increases to a volume size corresponding to the part chamber 15*c* which now has decreased relative to the position shown in FIGS. 6*a* and 6*b* and the corresponding volume size as shown in FIGS. 5*a*, 5*b*.

Figure 8A:
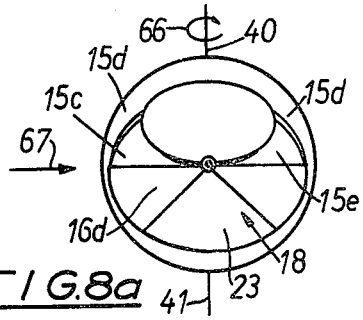
Figure 8B:
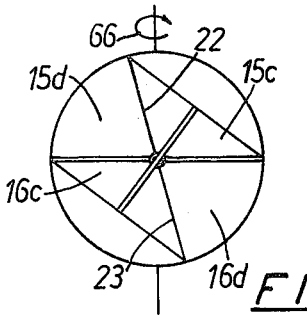

On further turning of the rotation shaft 42 an angle of 90° from the position shown in FIGS. 7*a* and 7*b* to the position shown in FIGS. 8*a* and 8*b*, a part chamber 15*d* moves towards its maximum (after 270° turning) while the part chamber 15*c* is further reduced. At the same time, the part chamber 15*c* is reduced, and there is built up on the same side of the main portion 19 of the piston, but on the opposite side (the rear side) of the abutment of the roller portion 22 against the partition plate 13, a new part chamber 15*e* (FIG. 8*a*).

On turning the rotation shaft further an angle of 90° back to the starting position, as shown in FIGS. 5*a*, 5*b*, the part chamber 15*c* is reduced to the minimum volume. Parallel to the volume development in the illustrated part chambers 15*b*–15*e* in the upper semi-spherical space 15, corresponding part chambers 16*b*–16*e* are obtained in the lower semi-spherical space 16.

In FIG. 9 the volume curve is shown for the part chambers 15*b*, 15*c*, 15*d* and 15*e*. It is evident from this that each part chamber requires a turning cycle of the rotation shaft 42 of 270° ($\frac{3}{4}$ of a revolution) in order to go from a minimum to a maximum and correspondingly 270° in order to go from a maximum back to a minimum. That is, a combined turning of the rotation shaft 22 of 540° (1.5 revolutions) is required in order to effect a complete suction and exhaust cycle in each part chamber.

From FIG. 9*a* it will also be evident that there are present three active part chambers wherein volume increases and volume reductions occur respectively at any time in the illustrated cycle of 540° (except in the positions as illustrated in FIGS. 5*a*, 5*b* and 7*a*, 7*b*). In any phase of the illustrated cycle, the volume on opposite sides of the piston is used to the maximum by means of the three active part chambers.

Corresponding volume changes for corresponding part chambers are shown in the volume curves as shown in FIG. 9*b*.

As indicated in FIGS. 9*a* and 9*b*, for each 360° turning of the rotation shaft 22, two equally large volumes will be ejected from each semi-spherical chamber 15, 16 respectively, that is together four equally large volumes in the compressor. Each such volume is as shown in FIGS. 9*a* and 9*b* in the illustrated embodiment of 56 cubic centimeters ($cm^3$), so that combined a volume yield of 224 $cm^3$ per 360° turning is obtained. The net inner volume of each part chamber (see FIGS. 5*b* and 7*b*) constitutes in the illustrated instance 32 cubic centimeters ($cm^3$), and the combined net inner volume of the part chambers (see especially FIGS. 5*b* and 7*b*) constitutes in consequence 128 $cm^3$. The total internal volume of the compressor is estimated at 288.6 $cm^3$, and compared with the volume yield of 224 $cm^3$ per 360° turning a capacity of 77.5% is obtained.

As mentioned above, the valve ports 37, 38 into the semi-spherical chamber 15 are positioned just by the crosshead pin 26. The ejection of the compressed volume from a first part chamber occurs prior to the rolling of the roller portion 22 across the crosshead pin 26 while the sucking into a part chamber which is built up on the opposite side of the piston 18 and on the opposite side of the crosshead pin 26 occurs just after the roller portion 22 has passed the crosshead pin 26. The different suction valves 37 and exhaust valves 38 can, if desired, be adjustable by means of regulatable pressure springs or other suitable pressure regulating means. Alternatively, the valves can be opened and closed by cam control from a chamber (not shown) on the crosshead pin 26 so that the valves open and close in fixed phases of the movement on the piston 10 in the compressor.

It must also be added that when the roller portion 22 of the piston 18 rolls against the roller track of the partition plate 13, the roller portion 22 makes a combined roll movement and push movement. In the illustrated embodiment where the roller portion 22 has a conic angle of about 120°, end portions of the roller portion 22 which have the largest diameter nevertheless have a substantially smaller diameter than the diameter of the semi-spherical chamber 15. When the rotation shaft 42 is turned 180°, the roller portion 22 is rolled correspondingly 130°, while being displaced 50° at the same time, that is to say for every 360° turning of the rotation shaft the roller portion rolls about 260°, while being displaced about 100°.

For the understanding of the solution according to the invention certain theoretical assumptions of the construction according to the invention shall be examined by reference to FIGS. 10*a* to 10*e*.

As the starting point for forming the working chambers of the machine, one begins with a spherically shaped hollow space 70 (FIG. 10*a*) which is surrounded by a permanent wall 71 (ball shell) which forms the outer boundary surface of the different workiing chambers and which, at the same time, forms a guide for the moveable parts 42, 18 in the spherically shaped hollow space 70. The different moveable parts are consequently adapted to move themselves in a turning and a sliding movement along the inner surface of the ball shell. The different moveable parts are moveable about different axes which all cross the center of the ball, so that the moveable parts can be separately considered as a part of an imaginary sphere which effects a controlled movement along the inner surface of the ball shell. Such an imaginary sphere, which is mounted in an associated ball shell, will thus be able to carry out any turn- or swing-movement about an arbitrarily chosen axis through the center of the ball, since this axis can always be a symmetrical axis for diametrically opposing parts of such an imaginary sphere.

Figure 10A:
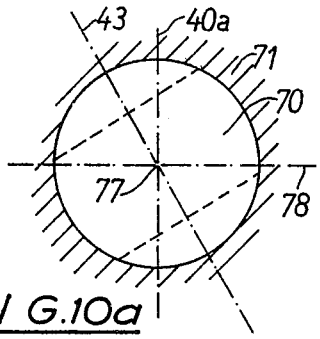

In FIG. 10*a* there are shown four such current symmetrical axes 40*a*, 43, 20 and 21 through the center point of the ball.

A first axis 40*a* (FIG. 10*b*) constitutes a common main axis for a pair of rotation shafts 40, 41, that is, the turn axis for an associated eccentric disc-forming connecting part 42, which is fixed to a respective rotation shaft 40, 41. The eccentric disc-forming connecting parts 42 are shown as ball skullcap parts by means of their respective mutually parallel cutting planes 80, 81, which are disposed an equal distance from the center point of the ball.

Between the cutting planes 80, 81 a center-symmetrical, ball belt-shaped hollow space 82 is defined which constitutes the theoretically optimum working chamber. The theoretically optimum working chamber is thus to a significant degree limited by the ball skullcap parts which form eccentric disc-forming connecting parts 42 on associated rotation shafts 40, 41.

Figure 10D:
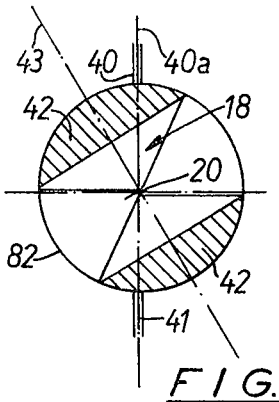
Figure 10B:
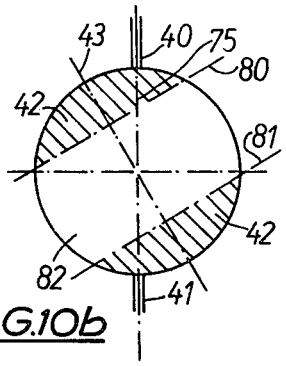
Figure 10E:
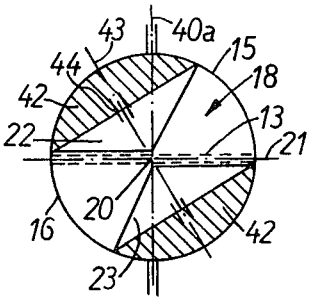
Figure 10C:
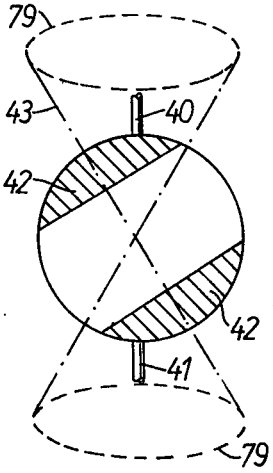

A second axis 43, which constitutes the center axis for the eccentric discs or the ball skullcap parts 42, will, as is illustrated by broken lines 79 in FIG. 10*c*, form a rotation surface in the form of a double conic surface. This second axis 43 also constitutes a control axis for controlling the symmetrical axis of a centrally moveable part 18 in a corresponding double conic surface-shaped path of movement (FIG. 10*c*). The centrally moveable part forms a piston 18 in the ball belt-shaped hollow space 82.

On turning of the moveable parts 42 about the axis 75, the intermediate ball belt-shapped hollow space 82 will be subjected to a rock movement within the spherically shaped hollow space 70 relative to the center point of the ball, the rock movement having a turning movement component corresponding to the turn movement of the part 42.

A third axis 20, which extends at right angles to the plane of the drawing FIG. 10*d*, constitutes a permanent turning axis for the central moveable portion, that is the piston 18. The piston 18 is consequently forced to be turned about the axis 20 at the same time as the piston is prevented from taking part in the movement about the shaft 40*a*. That movement which is transferred from the eccentric disc-forming moveable parts 42 to the piston-forming, central moveable part 18 via the shaft 43 constitutes, in consequence a corresponding rock movement to the rock movement of the ball belt-shaped hollow space 82. The symmetrical axis of the piston 18, which can coincide with the shaft 43, is consequently subject to a controlled movement in the path of movement of the shaft 43, which has a double conic form, without the piston thereby being turned about its symmetrical axis.

In FIG. 10*d* there is elucidated a conic angle of 120° which is reckoned from a conic angle point which is placed on the shaft 43 at a distance from the center of the ball corresponding to somewhat over half the thickness of the partition plate. The roller portion will as a result be able to effect a theoretical rolling off towards the partition plate along a line corresponding to the radius of the partition plate 13 within the spherical space 70.

A fourth axis 21 (FIG. 10*e*), which extends in the plane of the drawing at right angles to the axes 40*a* and 20, constitutes the central axis in a partition plate 13 which divides the spherically shaped hollow space 70 into two equally large, substantially semi-spherically shaped chambers 15, 16. At the same time, the partition plate 13 divides up the ball belt-shaped hollow space 82 into two equally large, wedge-like half parts. The axis 21 constitutes, at the same time, the central axis for a diametrically extending, through slot in the partition plate 13. This slot permits parts of the piston 18 to move forwards and backwards a definite swing arc through the slot, the piston being swung a correspondingly definite swing arc forwards and backwards about the axis 43. The piston which is controlled by the path of movement of the axis 43 is subjected thereby to a compound turning and rocking about the center of the ball, that is, about the axes 20 and 21, without the piston taking part in the turning movement about the axis 40*a*. Stated in another way, the movements of the piston are forcibly controlled depending upon the opposing control forces in the slot of the partition plate 13 and depending upon the control screws 44 which connect the connecting parts 42 and the rotation shafts 40, 41 with the piston 18.

As indicated in FIGS. 10*b*–10*e*, the largest diameter of the roller portions 22, 23 is substantially less than the diameter of the roller surface, that is the outer roller surface diameter of the partition plate 13. Thus, the rolling off movement which the roller portion 22 (23) is subjected to, does not constitute a pure rolling off movement, but comprises a combined rolling off movement and displacement movement. With a suitable clearance between the roller portion 22 (23) and the adjacent roller surface on the partition plate 13 the roller portion slides forward with a combined rolling off movement and a somewhat forwardly pushing slide movement. For example, the roller portion can effect a rolling off movement along the roller surface of the partition plate 13 of 260° and a pushing movement of 100°, while the rotation shafts 40, 41 make an angle turn of 360°.

Referring to FIG. 11, the pattern of movement for a zero fastening point and a 180° fastening point on the piston 18 are compared with the roller plane on the partition plate 13. As shown, the dash dot trace X represents a projection of the path of movement of a 0° point on a roller end portion, whereas the dot trace Y represents a projection of the path of movement of a 180° point on the roller end portion. The larger circle indicates the outer roller plane (on the surface of the partition plate 13) of the roller end portion, whereas the smaller circle represents the projection of the innermost roller plane on the inner semi-spherical chambers 15, 16. FIG. 12 schematically shows the pattern of movement of roller portion 22 (23) relative to the inner walls of the semi-spherical chamber 15, 16 taken in increments of 15°.

If a level piston had been employed, only a limited compression and limited expansion would have been attained in the two chamber formations which occur on opposite sides of the piston in each of the two semi-spherical chambers 15, 16. In order to achieve an optimum compression and a corresponding optimum expansion in the chamber formations, the piston has been designed with a centrally level main portion 19 and two mutually opposing, conic stump-shaped roller forming parts 22, 23. The roller-forming parts 22, 23 take part in the compound or combined turning and rocking movement of the piston 18 and execute, as a result, a rolling off movement about the axes 20, 21 in each of their semi-spherical chambers 15, 16 against the intermediate roller-surface forming partition plate 13. By means of the volume expelling roller portions 22, 23, there occurs quite definitely a certain further narrowing of the theoretical optimum work chamber 82 in the spherical hollow space 70—together with the narrowing from the main portion 19 of the piston 18 together with the narrowing from the partition plate 13. An essential effect of the roller parts 22, 23 is, however, that they produce an optimum compression in the subsequent part chamber formations, the roller parts being able theoretically to reduce the part chamber formations in certain phases to zero volume size by means of the rolling off movement against the roller surface-forming partition plate 13. Another significant effect is obtained on the rear side surface of the roller portion 22, 23, that is, at the conic surface side which has just effected a rolling off towards the roller surface-forming partition plate 13. Specifically, the roller portion produces a subsequently expanding part chamber formation on the same side of the piston in the associated semi-spherical chamber 15, 16 at the same time as the roller portion compresses a forwardly disposed part chamber formation in an associated semi-spherical chamber 15, 16. The pison 18 operates thereby, at the same time, as the three different part chambers in each semi-spherical space.

What is claimed is:

1. In a power conversion machine having a housing defining a double-curved space and having a partition plate fixedly mounted therein dividing said space into two semi-spherical chambers and having a diametrically extending slot therein; a piston including a disc-shaped main portion extending through said slot and having a pair of sector-shaped cavities; and a pair of conic-shaped roller portions, each said roller portion being fixed to said main portion within a respective cavity and being disposed on an opposite side of said partition from the other of said roller portions.

2. In a power conversion machine as set forth in claim 1, means for rolling each said roller portion on said plate about an axis perpendicular to said plate and passing through an intersection of said longitudinal axis with said second axis.

3. In a power conversion machine as set forth in claim 1, a cross-head pin rotatably mounted in said slot of said plate and having an aperture therein with said disc-shaped main portion extending therethrough whereby said main portion is pivotal about a longitudinal axis of said pin and rockable about a second axis perpendicular to said longitudinal axis and within the plane of said plate.

4. In a power conversion machine as set forth in claim 3, means for rolling each said roller portion on said plate about an axis perpendicular to said plate and passing through an intersection of said longitudinal axis with said second axis.

5. In a power conversion machine as set forth in claim 3 wherein said pin projects from each side of said plate and each said roller portion has a pair of diametrically opposed grooves therein for receiving said pin therein during movement of said respective roller portion over said pin.

6. In a power conversion machine as set forth in claim 3 wherein said housing has a pair of ports communicating with each respective semi-spherical chamber adjacent to and on opposite sides of each end of said pin.

7. In a power conversion machine as set forth in claim 6, wherein each port has a ball valve therein.

8. A power conversion machine comprising a housing having a pair of portions defining a double-curved space;

a stationary partition plate secured between said portions to divide said space into two semi-spherical chambers, said plate having a diametrically extending slot disposed along a first axis;

a piston including a disc-shaped main portion extending through said slot of said partition plate and a pair of oppositely directed roller portions, said main portion being disposed for pivoting about said first axis and for rocking about a second axis perpendicular to said first axis and intersecting at a center point of said space, each said roller portion being received in a respective one of said semi-spherical chambers for rolling on a respective side of said partition plate during pivoting of said main portion;

a rotary shaft extending into said housing on a third axis perpendicular to each of said first and second axes and passing through said center point; and an eccentric disc obliquely disposed to said shaft within one of said semi-spherical chambers and in driving relation with said roller portion in said one chamber, said disc being disposed on a fourth axis passing through said center point.

9. A power conversion machine as set forth in claim 1 which further comprises a second rotary shaft on said third axis and a second eccentric disc obliquely disposed to said second rotary shaft within the other of said semi-spherical chambers, said second eccentric disc being in driving relation with said roller portion in said other chamber.

10. A power conversion machine as set forth in claim 9 wherein each roller portion is rotatably connected with a respective eccentric disc and wherein each disc is integral with a respective shaft.

11. A power conversion machine as set forth in claim 9 wherein each roller portion has a conic stump surface for abutting said partition plate whereby said main piston portion and a respective roller portion divides a respective semi-spherical chamber into two working chambers and, during movement thereof on said partition plate, said respective roller portion divides one of said working chambers into two part-chambers.

12. A power conversion machine as set forth in claim 11 wherein said main piston portion is a circular disc having two oppositely disposed angular cavities each receiving a respective roller portion therein in fixed relation.

13. A power conversion machine as set forth in claim 8, wherein each housing portion includes a pair of inlet valves disposed on diagonally opposite sides of said housing portion and a pair of exhaust valves disposed on diagonally opposite sides of said housing portion and near a respective inlet valve.

14. A power conversion machine as set forth in claim 13, which further comprises a crosshead pin rotatably mounted in said slot opposite partition plate and having an aperture extending along said first axis and slideably receiving said main piston portion, said crosshead pin being disposed relative to said valves for opening and closing said inlet valves and said exhaust valves in sequence.

15. A power conversion machine as set forth in claim 14, wherein each roller portion has a conic surface for abutting said partition plate whereby said main piston portion and a respective roller portion divides a respective semi-spherical chamber into two working chambers and said respective roller portion divides one of said working chambers into two part-chambers during movement on said partition plate whereby each chamber has a working cycle of 540° and an angle displacement of 180° in relation to the remaining two chambers.

16. A power conversion machine comprising a housing having a pair of portions defining a double-curved space;

a stationary partition plate secured between said portions to divide said space into two semi-spherical chambers, said plate having a dimetrically extending slot disposed along a first axis;

a piston including a disc-shaped main portion extending through said slot of said partition plate and a pair of oppositely directed roller portions, said main portion being disposed for pivoting about said first axis and for rocking about a second axis perpendicular to said first axis and intersecting at a center point of said space, each said roller portion being received in a respective one of said semi-spherical chambers for rolling on a respective side of said partition plate during pivoting of said main portion;

a rotary shaft extending into said housing on a third axis perpendicular to each of said first and second axes and passing through said center point;

an eccentric disc obliquely disposed to said shaft within one of said semi-spherical chambers and in driving releation with said roller portion in said one chamber, said disc being disposed on a fourth axis passing through said center point;

a second rotary shaft on said third axis and a second eccentric disc obliquely disposed to said second rotary shaft within the other of said semi-spherical chambers, said second eccentric disc being in driving relation with said roller portion in said other chamber; and a crosshead pin rotatably mounted in said slot of said partition plate and having an aperture extending along said first axis and slidably receiving said main piston portion.

17. A power conversion machine as set forth in claim 16 wherein each roller portion has a conic stump surface for abutting said partition plate whereby said main piston portion and a respective roller portion divides a respective semi-spherical chamber into two working chambers and, during movement thereof on said partition plate, said respective roller portion divides one of said working chambers into two part-chambers.

18. A power conversion machine as set forth in claim 17 wherein said pin has a pair of oppositely disposed hemi-spherical projections at a central part thereof and each roller portion has a concave cavity at an apex thereof in slide fit relation with a respective projection of said pin.

* * * * *